US009447572B2

(12) United States Patent
Ricker et al.

(10) Patent No.: US 9,447,572 B2
(45) Date of Patent: Sep. 20, 2016

(54) STRUCTURE HAVING A STRENGTHENING ELEMENT MADE OF HIGH-STRENGTH CONCRETE FOR INCREASING PUNCHING SHEAR STRENGTH

(71) Applicant: HALFEN GmbH, Langenfeld (DE)

(72) Inventors: Marcus Ricker, Rodgau (DE); Dirk Albartus, Bochum (DE); Frank Haeusler, Duesseldorf (DE); Norbert Randl, Villach (AT)

(73) Assignee: HALFEN GmbH, Langenfeld (DE)

( * ) Notice: Subject to any disclaimer, the term of this patent is extended or adjusted under 35 U.S.C. 154(b) by 0 days.

(21) Appl. No.: 14/844,943

(22) Filed: Sep. 3, 2015

(65) Prior Publication Data

US 2016/0060859 A1 Mar. 3, 2016

(30) Foreign Application Priority Data

Sep. 3, 2014 (EP) ..... 14003044

(51) Int. Cl.

| | |
|---|---|
| ***E04B 1/41*** | (2006.01) |
| ***E04B 5/43*** | (2006.01) |
| ***E04B 1/21*** | (2006.01) |
| ***E04B 1/16*** | (2006.01) |
| ***E04B 5/17*** | (2006.01) |
| ***E04C 5/06*** | (2006.01) |

(52) U.S. Cl.

CPC ..... *E04B 1/21* (2013.01); *E04B 1/165* (2013.01); *E04B 1/40* (2013.01); *E04B 5/17* (2013.01); *E04B 5/43* (2013.01); *E04C 5/0645* (2013.01)

(58) Field of Classification Search

USPC ..... 52/98, 99

See application file for complete search history.

(56) References Cited

U.S. PATENT DOCUMENTS

| | | | | | |
|---|---|---|---|---|---|
| 5,174,081 | A * | 12/1992 | Reichartz | E04B 1/04 | 52/126.6 |
| 5,992,123 | A * | 11/1999 | Kies | E04C 5/0645 | 52/251 |
| 6,003,281 | A * | 12/1999 | Pilakoutas | E04C 5/0645 | 52/414 |
| 8,516,757 | B2 * | 8/2013 | Keller | E04B 5/43 | 52/223.14 |
| 2015/0345096 | A1 * | 12/2015 | Ong | E02D 5/24 | 405/252 |

FOREIGN PATENT DOCUMENTS

| | | | |
|---|---|---|---|
| JP | S63-151616 | U | 10/1988 |
| JP | H01-137048 | A | 5/1989 |
| KR | 100948486 | B1 | 3/2010 |
| NL | 7217435 | A | 6/1973 |

* cited by examiner

*Primary Examiner* — Elizabeth A Quast
(74) *Attorney, Agent, or Firm* — Walter Ottesen, P.A.

(57) ABSTRACT

A structure has a plate and a strengthening element made of high-strength concrete which increases the punching shear strength. The strengthening element is configured to have an annular shape and an opening. The strengthening element is made of multiple prefabricated segments which are arranged in an annular shape around the opening.

17 Claims, 7 Drawing Sheets

STRUCTURE HAVING A STRENGTHENING ELEMENT MADE OF HIGH-STRENGTH CONCRETE FOR INCREASING PUNCHING SHEAR STRENGTH

CROSS REFERENCE TO RELATED APPLICATION

This application claims priority of European patent application no. 14003044.6, filed Sep. 3, 2014, the entire content of which is incorporated herein by reference.

FIELD OF THE INVENTION

The invention relates to a structure having a strengthening element made of high-strength concrete for increasing punching shear resistance.

BACKGROUND OF THE INVENTION

JP Sho 63-151616 U discloses a structure in which a ring-shaped strengthening element made of concrete is provided which has a central opening, in the region of which there runs a pillar. The size of the opening is adapted to the size and contour of the pillar.

SUMMARY OF THE INVENTION

It is an object of the invention to provide a structure of the type described above wherein the production thereof is simplified.

A structure includes: a plate having a strengthening element of high-strength concrete for increasing punching shear strength; the strengthening element being configured to have an annular shape and to define an opening; and, the strengthening element including a plurality of prefabricated segments arranged annularly about the opening.

The strengthening element is made of multiple prefabricated segments which are arranged in ring-shaped fashion. The individual segments are easier to produce, transport and handle than a unipartite and correspondingly larger strengthening element. It has been found that, even with a strengthening element including multiple segments arranged in an annular-shaped fashion, a considerable increase in punching shear strength can be attained. The individual segments permit, to a certain extent, an adaptation of the size of the strengthening element.

It is advantageously the case that segments adjacent to one another in a circumferential direction have a spacing to one another and are connected to one another by way of a material of a lower strength than the high-strength concrete of the strengthening element. The adjacent segments are in particular connected to one another by way of the material of the slab, in particular by way of cast-in-place concrete. The spacing between adjacent segments is advantageously small. The spacing between adjacent segments advantageously amounts to at most 10 cm, in particular at most 5 cm, at the opening. In particular, the spacing between adjacent segments is no greater than 10 cm over the entire length of the gap formed between the adjacent elements. To realize a good connection of the adjacent segments to one another, the mutually adjacently situated longitudinal sides of the segments are advantageously provided with a contour which activates the multiaxial compressive strength of the casting material. To increase the strength of the connection, at least one reinforcement element of the strengthening element projects into the gap formed between two adjacent segments. It is advantageously the case that reinforcement elements of both adjacent segments project into the gap and overlap in order to realize a high strength.

In order that only a small number of different individual parts has to be kept available on a construction site, it is advantageously provided that at least two segments of the strengthening element are of identical form. Particularly advantageous embodiments are obtained if the strengthening element is constructed from at most two different segments. It is particularly advantageously the case that all of the segments of a strengthening element are of identical form.

To increase the punching shear strength, it is provided that the slab has a punching shear reinforcement. High punching shear strength can be achieved if at least one segment has a groove into which a reinforcement element of the punching shear reinforcement projects. The reinforcement element is in particular a shear stud or shear anchor. The arrangement in the groove also yields simplified production, as the reinforcement element can be pre-positioned on the strengthening element. The reinforcement element of the punching shear reinforcement is advantageously fixed in the groove by way of a material of lower strength than the high-strength concrete of the strengthening element. It is advantageously the case that the reinforcement element is fixed by way of the material of the slab, in particular by way of cast-in-place concrete. In particular in the case of a small groove width, the reinforcement element is cast into a material other than the material of the slab, in particular into flowable mortar. The mortar may in this case be mortar of normal strength or high-strength grouting mortar. It is advantageous that the at least one groove is of closed form on the side facing toward the pillar. In this way, the positioning of the punching shear reinforcement is simplified. At the same time, the strength of the strengthening element in the region immediately surrounding the opening is not reduced. A good incorporation of the strengthening element into the slab is achieved if at least one reinforcement element of the punching shear reinforcement is arranged outside the strengthening element.

The slab advantageously has a lower reinforcement. A high strength is attained if the lower reinforcement runs above the strengthening element. In this case, the lower reinforcement is advantageously equipped, adjacent to the edge region of the strengthening element, with an upward offset portion. It may however also be provided that the lower reinforcement runs in suitable recesses of the strengthening element. An upward offset portion of the lower reinforcement may then be omitted. The edge region of the strengthening element is advantageously of beveled form. This yields a practical force profile and a good distribution of force into the slab.

In the present case, the expression "concrete" is used as an umbrella term and generally refers to a construction material which is formed as a mixture of a binding agent and an aggregate, specifically regardless of the grain size. Mortar thus also falls within the umbrella term "concrete" used here. The concrete may include admixtures and additives. High-strength concrete refers to a concrete with a compressive strength of greater than 55 $N/mm^2$. The high-strength concrete of the strengthening element is in particular an ultrahigh-strength concrete (UHPC (ultra high performance concrete)) with a compressive strength of over 130 $N/mm^2$, in particular of over 200 $N/mm^2$. The high-strength concrete of the strengthening element is in particular a fiber-reinforced, ultrahigh-strength concrete.

The structure advantageously has a pillar which is connected to the slab and which is arranged in the region of the opening of the strengthening element. Via the strengthening element, the forces introduced into the slab by the pillar can be absorbed and distributed in an effective manner. Provision may however also be made for the strengthening element to be arranged in a region of the slab in which increased support loads must be absorbed by the slab, for example owing to machines which are set up on the slab.

The opening is advantageously arranged centrally in the strengthening element. An eccentric arrangement of the opening may however also be advantageous, for example in the case of restricted space conditions or for adaptation to the loads to be absorbed.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
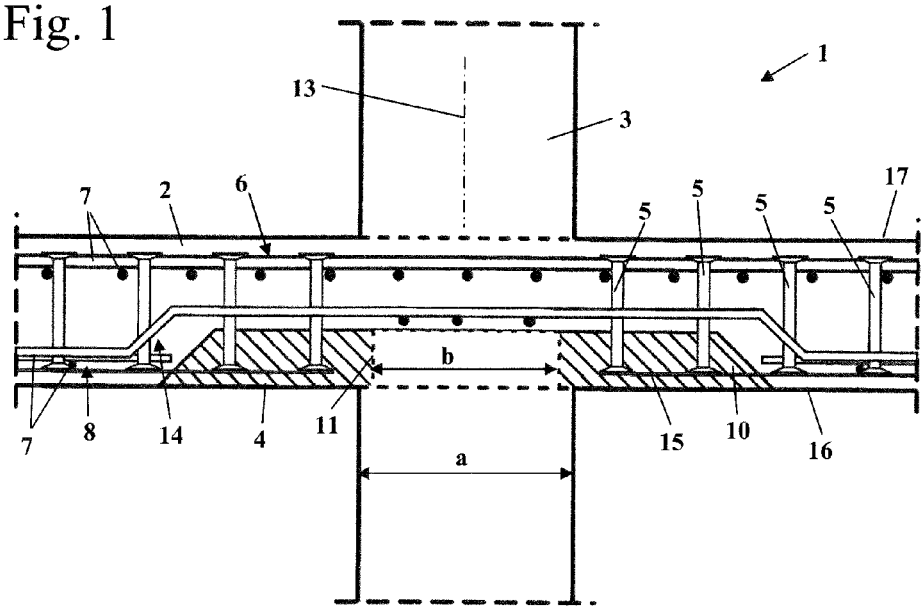
FIG. 1 is a schematic detail illustration of a structure in the connecting region between a slab and a pillar.

FIG. 1 schematically shows a structure 1 made of concrete. The structure 1 has a slab 2 which runs horizontally and which may for example be a floor slab. On the slab 2 there is arranged a pillar 3 which runs vertically. In the embodiment, the pillar 3 extends through the slab 2. It may however also be provided that the slab 2 rests on the pillar 3, or that the pillar 3 extends only above the slab 2. The slab 2 has a lower reinforcement 8, which is arranged adjacent to a slab underside 16 of the slab 2, and an upper reinforcement 6, which runs in the slab 2 adjacent to a slab upper side 17. The upper reinforcement 6 and the lower reinforcement 8 are, in the conventional manner, formed from criss-crossing reinforcement bars 7 arranged in a lattice. In the region of the pillar 3, a strengthening element 4 is provided which increases the punching shear strength of the slab 2 at the pillar 3.

The strengthening element 4 is a prefabricated component made of high-strength, preferably ultrahigh-strength concrete. The strengthening element 4 may additionally have a fiber reinforcement made preferably of plastics fibers and/or steel fibers. The strengthening element 4 is arranged in the slab 2 at the slab underside 16. The lower reinforcement 8 runs above the strengthening element 4. The lower reinforcement 8 has, adjacent to an edge region 10 of the strengthening element 4, an upward offset portion 14 which realizes an upward offset of the lower reinforcement 8, approximately into the middle of the slab 2. In a further embodiment which is not shown, the lower reinforcement 8 does not have an upward offset portion but runs in suitable recesses of the strengthening element 4. The slab 2 furthermore has a punching shear reinforcement which, in the embodiment, is formed from a multiplicity of shear studs 5. The shear studs 5 are, in the embodiment, in the form of double-headed studs. Other types of punching shear reinforcement, for example in the form of filigree members or the like, are however possible. The shear studs 5 are held on an installation strip 15. In this way, the spacing of the shear studs 5 to one another is fixed, and the shear studs 5 are already pre-fixed on the installation strip 15 during the production process.

Figure 2:
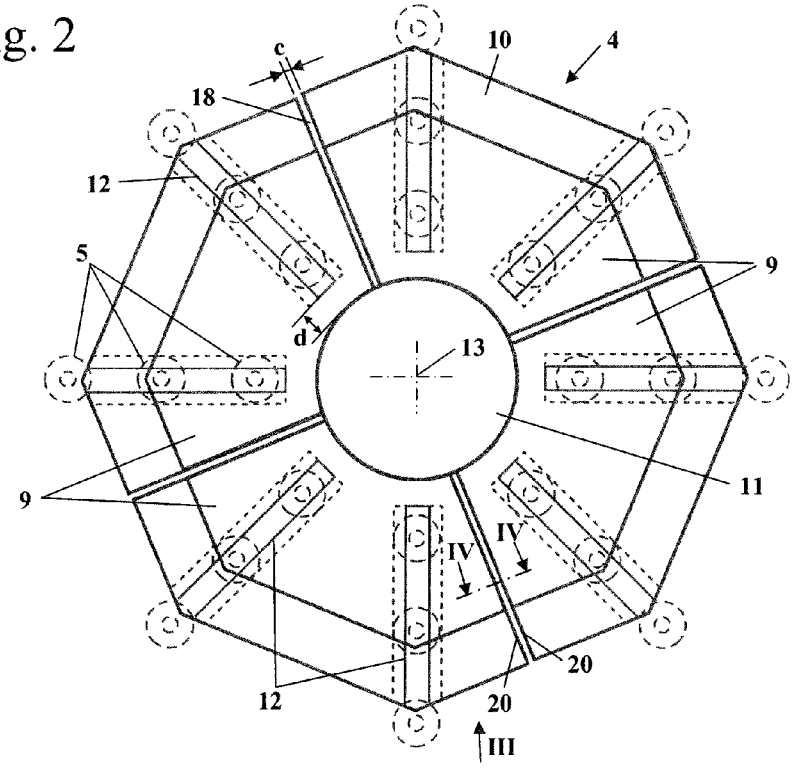
FIG. 2 shows a plan view of the strengthening element of the structure from FIG. 1.

As is also shown in FIG. 1, the strengthening element 4 has an opening 11 which, in the embodiment, is provided centrally in the strengthening element 4 and which extends through the strengthening element 4. In the embodiment, the opening 4 is of circular form, as is also shown in FIG. 2. The inner diameter (b) of the opening 11 is slightly less than the outer diameter (a) of the pillar 3, which likewise has a circular cross section. The opening 11 is arranged concentrically around a longitudinal central axis 13 of the pillar 3, such that the strengthening element 4 and the pillar 3 overlap slightly in the edge region in a plan view. The internal length of the strengthening element 4 at the opening 11 advantageously amounts to at least 75%, in particular at least 90%, of the circumferential length of the pillar 3. The internal length is in this case the sum of the lengths of those end faces of the segments 9 which face toward the opening 11, wherein spacings between the segments 9 are not included in the internal length.

FIG. 2 shows the construction of the strengthening element 4 in detail. In the embodiment, the strengthening element 4 has an octagonal outer contour. The strengthening element 4 is constructed from multiple, in the embodiment four, identical segments 9 which are arranged in ring-shaped fashion around the pillar 3 or around the elongation of the pillar 3 into the slab 2. Adjacent segments have a spacing (c) to one another, the spacing advantageously being relatively small. The spacing (c) is advantageously at most 10 cm, in particular at most 5 cm, at the opening 11. A gap 18 is formed between adjacent segments 9 owing to the spacing (c). Each gap 18 is delimited by two mutually adjacent side walls 20 of the adjacent segments 9. The spacing (c) is advantageously constant over the entire length of the joint 18, that is, in a direction radially with respect to the longitudinal direction 13. As shown in FIG. 2, the strengthening element 4 has grooves 12 in which the shear studs 5, shown by dashed lines in FIG. 2, are arranged. In the embodiment, each segment 9 has two grooves 12 which extend in a radial direction with respect to the longitudinal central axis 13. Each groove 12 opens out at one of the corner points of the octagonal outer circumference. As is schematically shown in FIG. 2, shear studs 5 of the punching shear reinforcement are also arranged outside the strengthening element 4 in an elongation of the grooves 12. The grooves 12 do not extend as far as the opening 11 but have a spacing (d) to the opening 11. The grooves 12 are thus configured to be closed in the direction of the opening 11.

Figure 3:
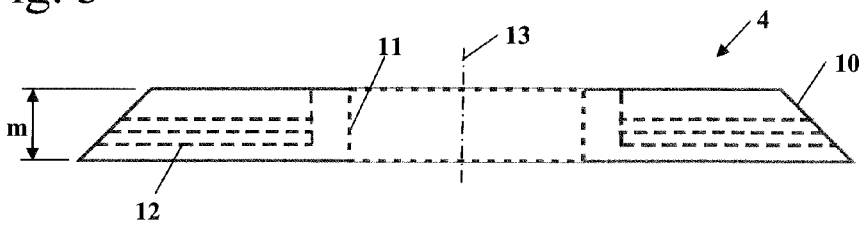
FIG. 3 shows a schematic side view in the direction of the arrow III in FIG. 2.

FIG. 3 shows the profile of the grooves 12 in a side view. As shown in FIG. 3, the grooves 12 extend over a major part of the height (m), measured parallel to the longitudinal central axis 13, of the strengthening element 4. As also shown in FIG. 3, the edge region 10 of the strengthening element 4 is of beveled configuration, such that the height of the strengthening element 4 decreases in the edge region 10. In the embodiment, the height (m) amounts to less than half of the thickness of the slab 2, as is also shown in FIG. 1.

Figure 4:
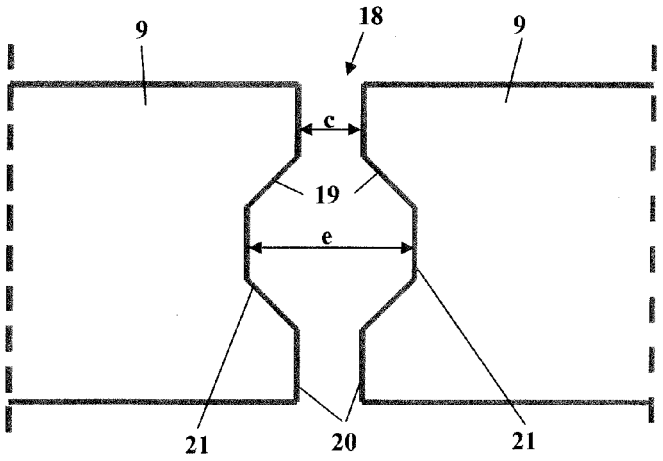
FIG. 4 shows a detail sectional illustration along the line IV-IV in FIG. 2.
Figure 5:
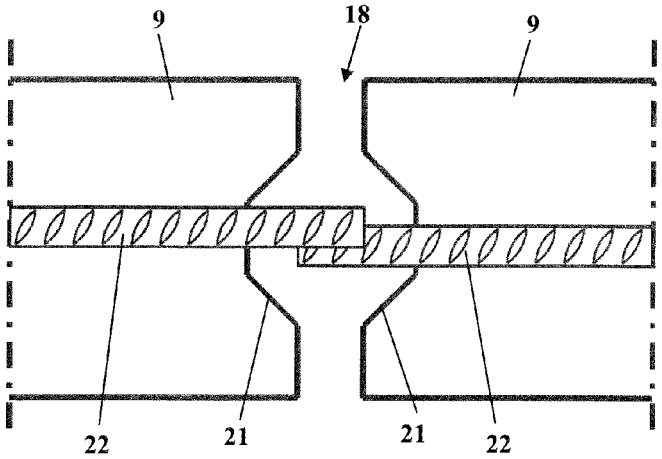
FIG. 5 is a sectional illustration corresponding to FIG. 4 in a configuration variant.

FIGS. 4 and 5 show embodiments for the configuration of the joint 18 between adjacent segments 9. As shown in FIG. 4, the side walls 20 each have a groove 21 which is formed into the face side of the side wall, the side walls 19 of which grooves run obliquely. The width of the groove 21 thus decreases with increasing depth of the groove 21. In the middle region of the segments 9, the joint 18 has a width (e) considerably greater than the spacing (c) of the segments 9 to one another at the outer side of the strengthening element 4. Via the oblique side walls 19 of the grooves 21, multiaxial loading in the joint 18 is realized, which activates the multiaxial compressive strength of the casting material, in particular of the cast-in-place concrete. The strength of the casting material is in this case advantageously lower than that of the strengthening element 4. In the case of a very small width (c) of the groove 21, in particular in the case of a width (c) of 2 cm or less, it is advantageously the case that flowable grouting mortar is used as casting material. In this way, it is possible to achieve good, complete filling of the groove 21 with casting material. The grouting mortar may in this case be high-strength grouting mortar or normal-strength grouting mortar. The use of grouting mortar as casting material may also be advantageous in the case of relatively large widths (c) of the groove 21. The strengthening element 4 is made of a high-strength concrete, the compressive strength of which is advantageously greater than 55 $N/mm^2$. The strengthening element 4 is in particular made of ultrahigh-strength concrete with a compressive strength of greater than 130 $N/mm^2$. The ultrahigh-strength concrete may additionally be fiber-reinforced, in particular with plastics fibers and/or steel fibers.

In the embodiment shown in FIG. 5, reinforcement elements 22 of the adjacent segments 9, which reinforcement elements are in the form of reinforcement bars, project into the joint 18. Here, the reinforcement elements 22 overlap in the joint 18. The length of that section of each reinforcement element 22 which projects into the joint 18 is in this case greater than half of the spacing between the segments 9 in the region. Increased strength is attained in this way.

Figure 6:
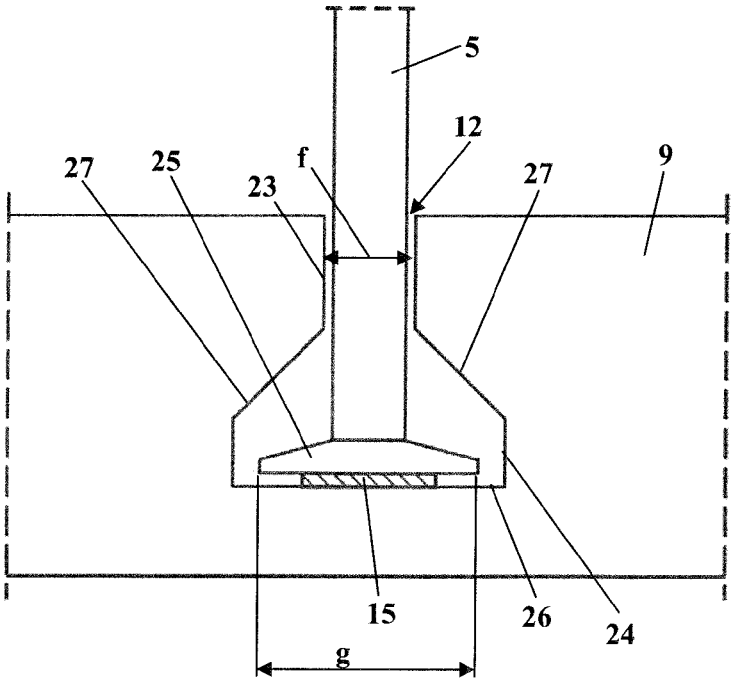
FIG. 6 shows a section through a groove of the strengthening element from FIG. 2 with a shear stud arranged therein.

FIG. 6 shows an embodiment for the configuration of a groove 12 in a segment 9. The shear studs 5 have a head 25 which is fixed to the installation strip 15. The groove 12 has a cross section which widens in the interior of the segment 9. The groove 12 has an upper region 23, the width (f) of which is smaller than the width (g) of the head 25. The shear stud 5 therefore cannot be pulled upward in its longitudinal direction out of the groove 12. Rather, the shear stud 5 must be installed on the strengthening element 4 in the longitudinal direction of the groove 12, and radially from the outside in relation to the longitudinal central axis 13 of the pillar 3. The groove 12 has a lower region 24, the width of which is greater than that of the head 25. The inner region 24 has oblique side walls 27 which activate the multiaxial compressive strength of the grouting mortar. The installation strip 15 lies on a groove base 26 of the groove 12.

Figure 7:
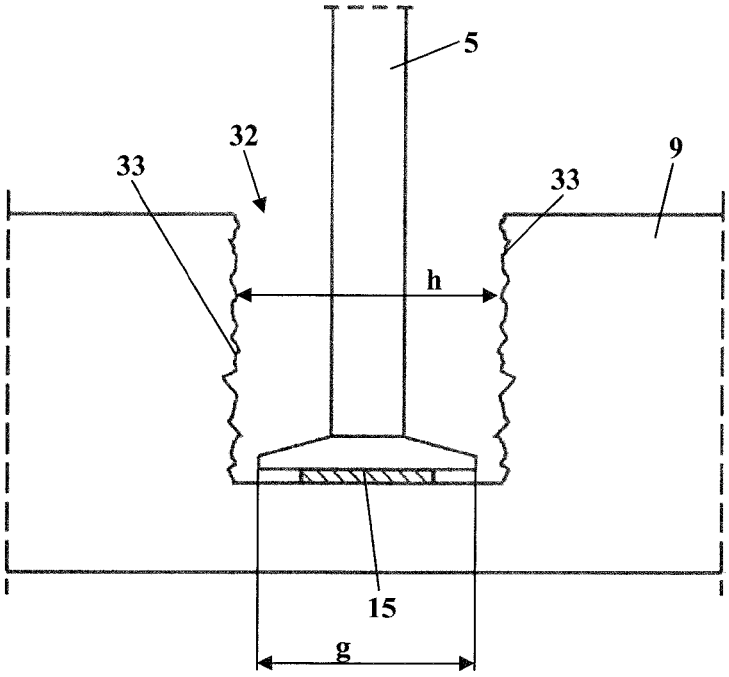
FIG. 7 shows a configuration variant of a groove and a sectional illustration as per FIG. 6; and, FIG. 8 shows a plan view of an embodiment of a strengthening element, with a pillar shown in section.

In the embodiment shown in FIG. 7, a groove 32 is provided which has an approximately constant width (h). The width (h) is greater than the width (g) of the head 25 of the shear stud 5. The groove 32 has side walls 33 which have a rough surface. The surface of the side walls 33 may also be of profiled or toothed form. The structure of the side walls 33 yields a good connection with the casting compound, which fixes the shear studs 5 in the groove 32. In this embodiment, the shear studs 5 can be installed on the strengthening element 4 from above.

Figure 8:
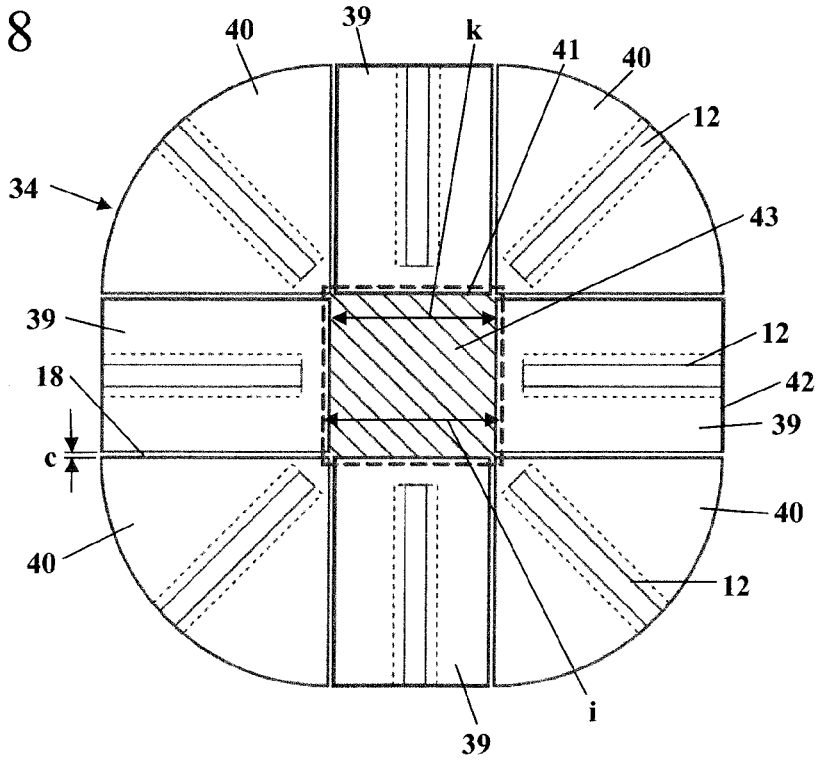

FIGS. 8 to 14 show different embodiments of strengthening elements. FIGS. 8 to 12 show strengthening elements whose outer contour is a rounded square or rectangular cross section. This yields a configuration similar in appearance to a stadium. The strengthening element 34 shown in FIG. 8 is arranged adjacent to a pillar 43 of square cross section. The pillar 43 has a width (i). The strengthening element 34 has an opening 41 which is arranged in the region of the pillar 43 and the width (k) of which is slightly smaller than the width (i). The strengthening element 34 is constructed from prefabricated segments 39 and 40 made of high-strength concrete. There are four segments 39 provided which have a rectangular form in a plan view and the width of which corresponds approximately to the width of the opening 41. Each segment 39 has a groove 12 which is closed in the direction of the opening 41. The segments 39 have a straight outer edge 42 which is arranged in each case parallel to a side of the pillar 43. Between adjacent segments 39 there is arranged in each case one segment 40 which is in the shape of a quadrant. Each segment 40 has an outwardly running groove 12. The adjacent segments (39, 40) have a spacing (c) to one another such that a joint 18 is formed between the adjacent segments (39, 40).

Figure 9:
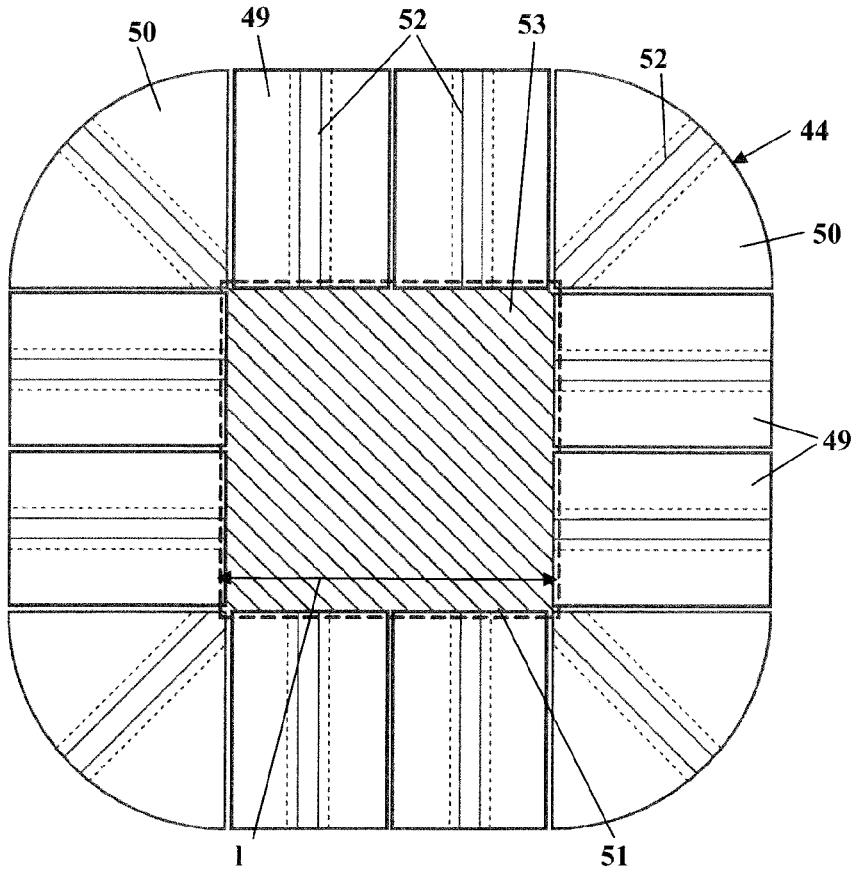
FIG. 9 shows a plan view of an embodiment of a strengthening element, with a pillar shown in section.

FIG. 9 shows a strengthening element 44 which is constructed from segments 49 and 50. It would also be possible for the strengthening element 44 to be constructed from segments 39 and 40. The segments 49 and 50 differ from the segments 39 and 40 by the groove 52 which is configured to be open toward the opening 51 of the strengthening element 44. A groove 12 which is closed in the direction of the opening 51 may however also be advantageous. The pillar 53 has a width (l) which is approximately twice the width (i) of the pillar 43. The strengthening element 44 is constructed from a total of eight segments 49, wherein two segments 49 are arranged adjacent to one another on each side of the pillar 53. At the corners of the pillar 53 there are arranged segments 50 which are of quadrant-shaped form in plan view and the shape of which corresponds approximately to the segments 40. The segments 50 also each have a groove 52 which is open toward the opening 51.

Figure 10:
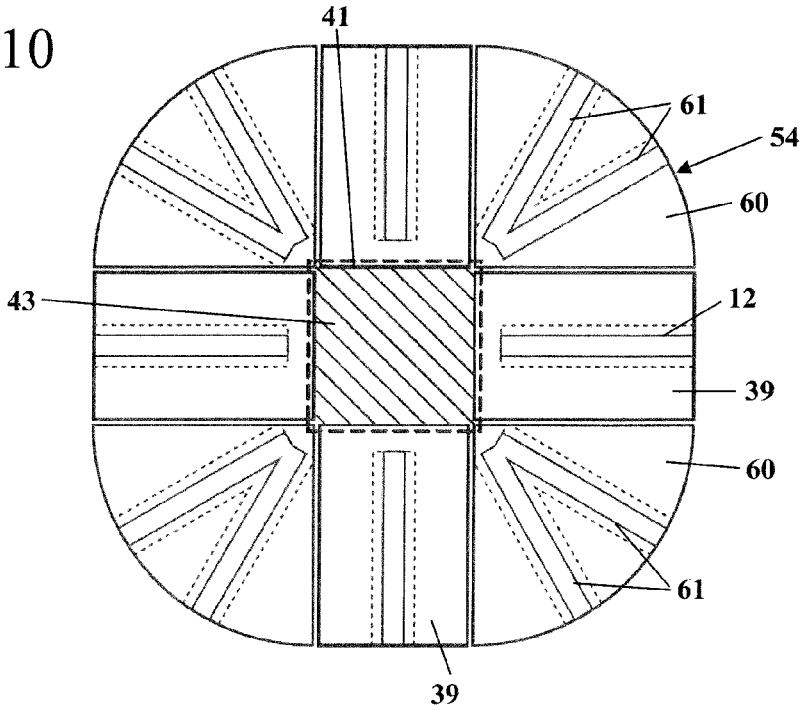
FIG. 10 shows a plan view of an embodiment of a strengthening element, with a pillar shown in section.

In the case of the strengthening element 54 shown in FIG. 10, segments 39 and 60 are provided. The strengthening element 54 is arranged on a pillar 43, wherein one segment 39 is arranged on each longitudinal side of the pillar 43. At the corners of the pillar 43 there are provided segments 60 which are of quadrant-shaped form and which each have two grooves 61. The grooves 61 are closed in the direction of the opening 41 of the strengthening element 44 but are connected to one another at their end situated adjacent to the pillar 43.

Figure 11:
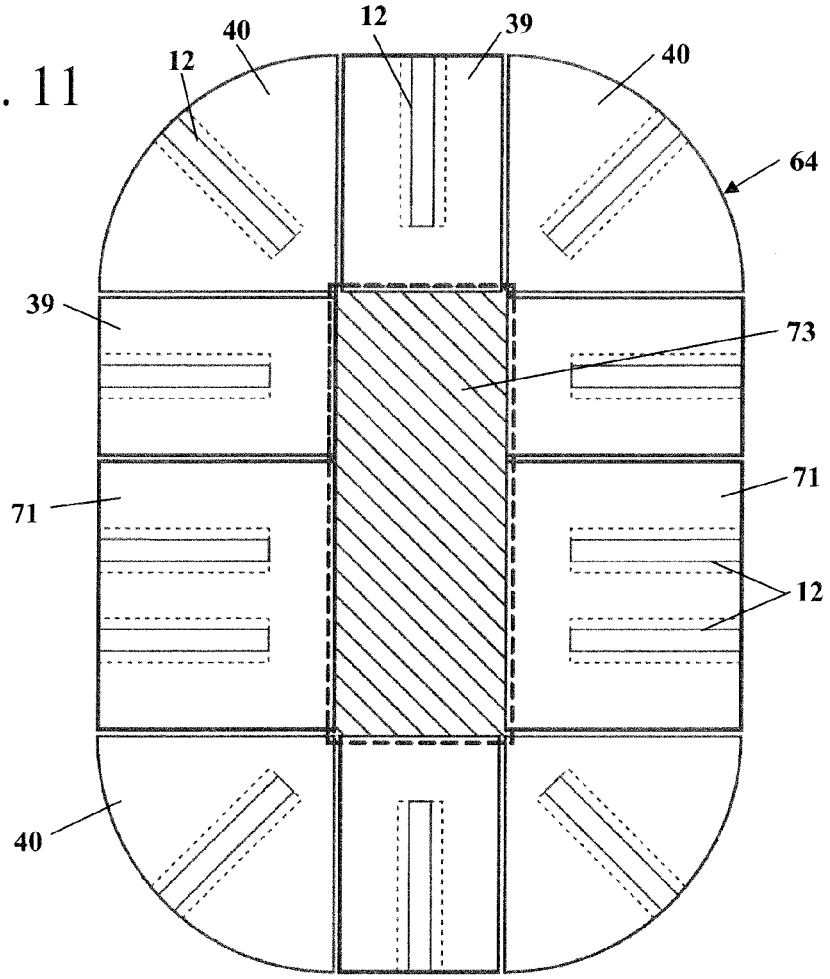
FIG. 11 shows a plan view of an embodiment of a strengthening element, with a pillar shown in section.
Figure 12:
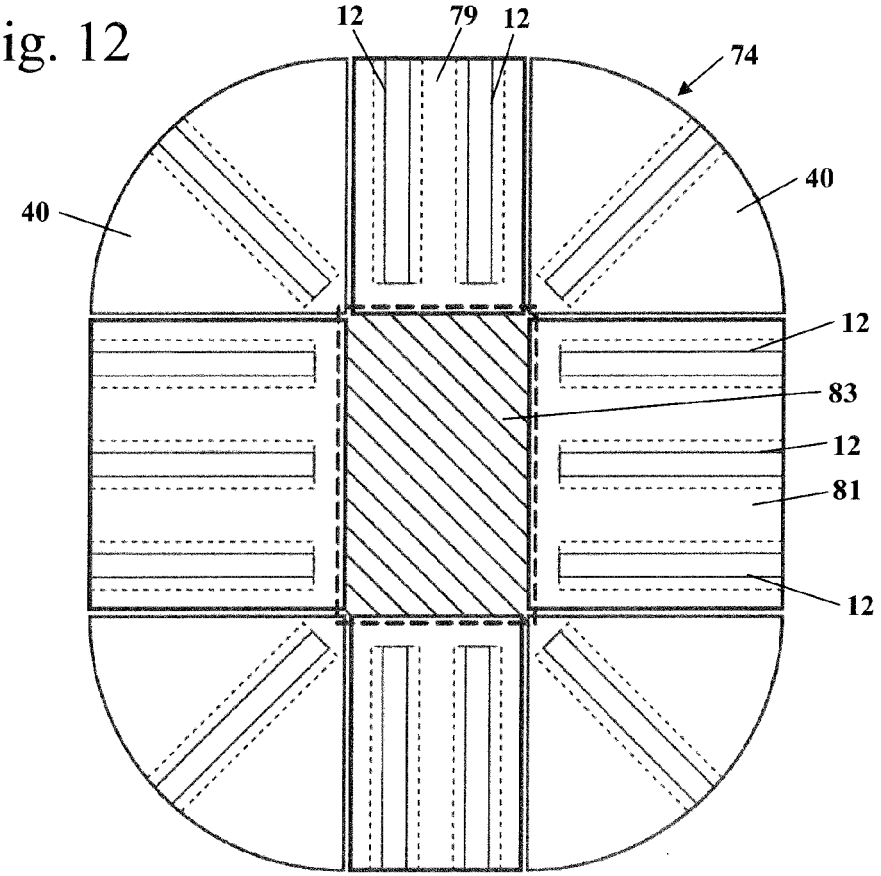
FIG. 12 shows a plan view of an embodiment of a strengthening element, with a pillar shown in section.

FIG. 11 shows an embodiment of a strengthening element 64 which is constructed from segments 39 and 40 and segments 71. The strengthening element 64 is arranged on a pillar 73 which has a rectangular cross section. In each case one segment 39 and one segment 71 are arranged on the long sides of the rectangular cross section of the pillar 73. Each segment 71 has two grooves 12. The width of the segments 71 is greater than that of the segments 39.

In the production of a structure, a strengthening element (4, 34, 44, 54, 64, 74, 84, 94) is arranged above a pillar (3, 43, 53, 73, 83, 93) or above a formwork for a pillar (3, 43, 53, 73, 83, 93). The shear studs 5 of the punching shear reinforcement are arranged in the grooves (12, 32, 52, 61) of the strengthening element (4, 34, 44, 54, 64, 74, 84, 94). After the fitting of the lower reinforcement 8 and of the upper reinforcement 6 of the slab 2, cast-in-place concrete is introduced in order to produce the slab 2 and, if appropriate, to produce the pillar (3, 43, 53, 73, 83, 93). The cast-in-place concrete simultaneously serves for connecting the segments (9, 39, 40, 49, 50, 60, 71, 79, 81, 89, 99) of the strengthening element to one another and for fixing the punching shear reinforcement in the grooves (12, 32, 52, 61) of the strengthening element (4, 34, 44, 54, 64, 74, 84, 94).

Figure 13:
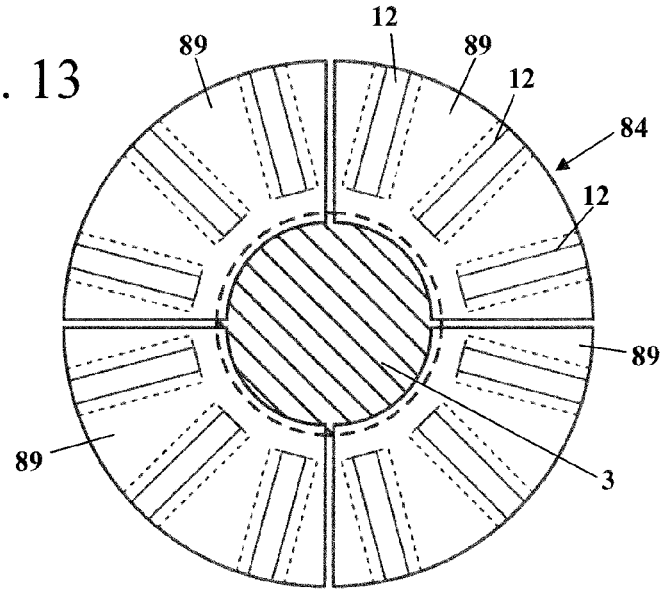
FIG. 13 shows a plan view of an embodiment of a strengthening element, with a pillar shown in section; and, FIG. 14 shows a plan view of an embodiment of a strengthening element, with a pillar shown in section.

FIG. 13 shows an embodiment of a strengthening element 84 which is arranged on a circular pillar 3. The strengthening element 84 is constructed from four identical segments 89 which each have three grooves 12. The outer edge of the strengthening element 84 is circular.

Figure 14:
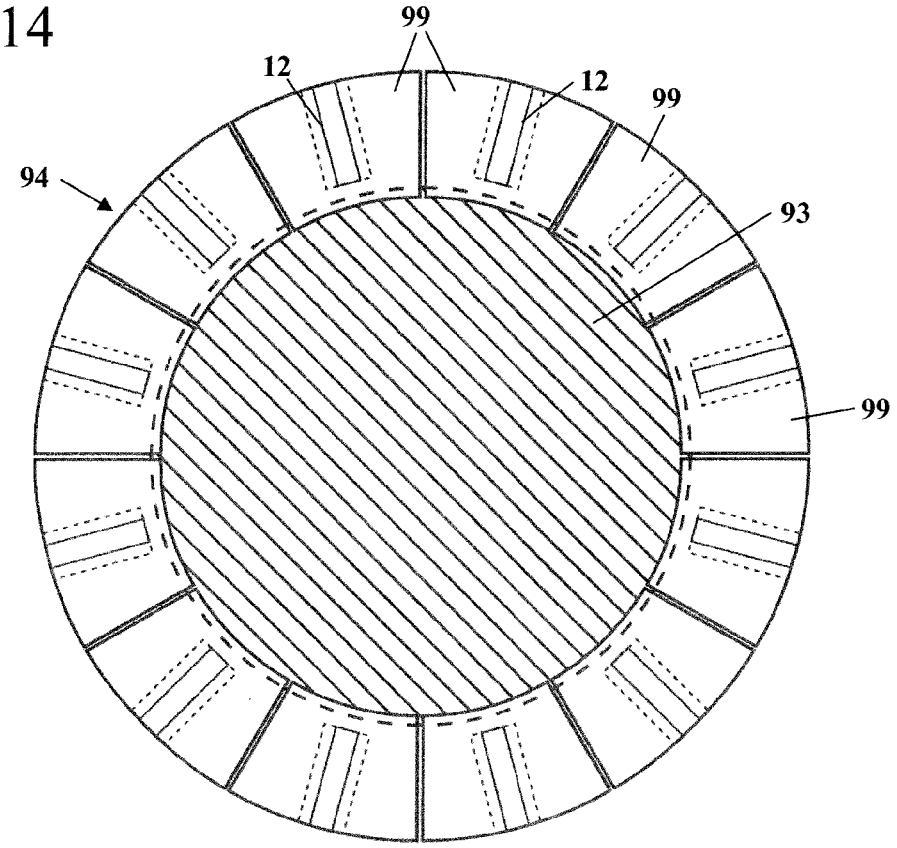

FIG. 14 shows a circular strengthening element 94 with a circular inner cross section and a circular outer cross section. The strengthening element 94 is arranged on a pillar 93. The strengthening element 94 is constructed from twelve segments 99 which each have one groove 12. All of the segments 99 are of identical form. In all of the embodiments, the spacing between adjacent segments is relatively small, and amounts to at most 10 cm. Those side walls 20 of the adjacent segments which face toward one another run parallel to one another, such that the spacing (c) of the adjacent segments is constant over the entire joint length. The spacing varies only in the direction of the depth of the joint 18, as shown in FIGS. 4 and 5.

The embodiments provide grooves in the segments, in which grooves the shear studs 5 are arranged. Provision may however alternatively or additionally be made for reinforcement elements of a punching shear reinforcement to be arranged in joints between adjacent segments. The edge region 10 is advantageously of beveled form in all embodiments, even though the beveling has only been shown in the case of the strengthening element 4.

In the production of a structure, a strengthening element (4, 34, 44, 54, 64, 74, 84, 94) is arranged above a pillar (3, 43, 53, 73, 83, 93) or above a formwork for a pillar (3, 43, 53, 73, 83, 93). The shear studs 5 of the punching shear reinforcement are arranged in the grooves (12, 32, 52, 61) of the strengthening element (4, 34, 44, 54, 64, 74, 84, 94). After the fitting of the lower reinforcement 8 and of the upper reinforcement 6 of the slab 2, cast-in-place concrete is introduced in order to produce the slab 2 and, if appropriate, to produce the pillar (3, 43, 53, 73, 83, 93). The cast-in-place concrete simultaneously serves for connecting the segments (9, 39, 40, 49, 50, 60, 71, 79, 81, 89, 99) of the strengthening element to, one another and for fixing the punching shear reinforcement in the grooves (12, 32, 52, 61) of the strengthening element (4, 34, 44, 54, 64, 74, 84, 94).

As an alternative production variant, it may be practical, after the arrangement of the strengthening element (4, 34, 44, 54, 64, 74, 84, 94), for flowable grouting mortar to be introduced into the grooves (12, 32, 52, 61) and/or into the joints 18, which grouting mortar fixes the punching shear reinforcement in the grooves (12, 32, 52, 61) and/or connects the segments (9, 39, 40, 49, 50, 60, 71, 79, 81, 89, 99) to one another. The strengthening element (4, 34, 44, 54, 64, 74, 84, 94) can subsequently be cast into the cast-in-place concrete of the slab 2.

In the embodiments, the strengthening element (4, 34, 44, 54, 64, 74, 84, 94) is arranged in each case in the region of a pillar (3, 43, 53, 73, 83, 93). The strengthening element (4, 34, 44, 54, 64, 74, 84, 94) may however also be provided for the strengthening of a slab in a region in which no pillar is provided. The strengthening element (4, 34, 44, 54, 64, 74, 84, 94) then serves in particular for increasing the punching shear resistance of the slab 2 in a highly loaded region of the slab 2, for example in a region on which it is intended to set up heavy loads such as heavy machines or the like.

In the case of the strengthening elements (4, 34, 44, 54, 64, 74, 84, 94) shown, the opening (11, 41, 51) is provided in each case centrally in the strengthening element (4, 34, 44, 54, 64, 74, 84, 94). The geometric center of the strengthening element (4, 34, 44, 54, 64, 74, 84, 94) in this case coincides with the geometric center of the opening (11, 41, 51). In a further embodiment which is not shown, the opening (11, 41, 51) may however also be arranged eccentrically.

It is understood that the foregoing description is that of the preferred embodiments of the invention and that various changes and modifications may be made thereto without departing from the spirit and scope of the invention as defined in the appended claims.

What is claimed is:

1. A structure comprising:

a plate having a strengthening element of high-strength concrete for increasing punching shear strength with said high-strength concrete having a compressive strength of at least 55 $N/mm^2$;

said strengthening element being arranged in said plate and being configured to have an annular shape and to define an opening;

said strengthening element including a plurality of prefabricated individual segments arranged annularly about said opening; and, each two mutually adjacent ones of said plurality of prefabricated individual segments conjointly defining a distance (c) therebetween and being bonded to each other by casting material.

2. The structure of claim 1, wherein said casting material has a strength less than said high-strength concrete of said strengthening element.

3. The structure of claim 2, wherein said distance (c) is at most 10 cm at said opening.

4. The structure of claim 2, wherein mutually adjacent ones of said plurality of prefabricated individual segments define gaps therebetween; and, said strengthening element having reinforcing elements projecting into said gaps.

5. The structure of claim 1, wherein at least two of said plurality of prefabricated individual segments are configured identically.

6. The structure of claim 1, wherein said plate includes a punching shear reinforcement.

7. The structure of claim 6, wherein said punching shear reinforcement includes a reinforcing element; at least one of said plurality of prefabricated individual segments has a groove; and, said reinforcing element of said punching shear reinforcement projects into said groove.

8. The structure of claim 7, wherein said reinforcing element of said punching shear reinforcement is fixed in said groove with a material having a strength less than that of said high-strength concrete of said strengthening element.

9. The structure of claim 6, wherein said punching shear reinforcement has at least one reinforcing element; and, said at least one of said reinforcing elements is arranged outside of said strengthening element.

10. The structure of claim 7 further comprising:

a pillar;

said groove having an end facing said pillar; and, said end of said groove facing said pillar being closed.

11. The structure of claim 1, wherein said plate has a lower reinforcement running above said strengthening element.

12. The structure of claim 11, wherein said strengthening element has an edge region; and, said lower reinforcement of said plate has an upward offset portion disposed adjacent to said edge region.

13. The structure of claim 1, wherein said strengthening element has a beveled edge region.

14. The structure of claim 1 further comprising a pillar connected to said plate and arranged in a region of said opening.

15. The structure of claim 1, wherein said plate is a flat slab.

16. The structure of claim 1, wherein said casting material is cast-in-place concrete or grouting mortar.

17. A structure comprising:

a plate having a strengthening element of high-strength concrete for increasing punching shear strength with said high-strength concrete having a compressive strength of at least 55 $N/mm^2$;

said strengthening element being configured to have an annular shape and to define an opening;

said strengthening element including a plurality of prefabricated segments arranged annularly about said opening;

said plate including a punching shear reinforcement;

said punching shear reinforcement including a reinforcing element;

at least one of said plurality of prefabricated segments having a groove;

said reinforcing element of said punching shear reinforcement projecting into said groove;

said reinforcing element of said punching shear reinforcement being fixed in said groove with a material having a strength less than that of said high-strength concrete of said strengthening element; and, said material being cast-in-place concrete.

* * * * *